United States Patent [19]

Yoshino et al.

[11] Patent Number: 4,839,204

[45] Date of Patent: Jun. 13, 1989

[54] RESIN COATED METAL PIPE HAVING A PLANE SURFACE FOR A LIGHTWEIGHT STRUCTURE

[75] Inventors: Syuji Yoshino; Satoshi Makino; Mitsuo Fujita; Yukio Shimizu, all of Shizuoka, Japan

[73] Assignee: Yazaki Kakoh Co., Ltd., Shizuoka, Japan

[21] Appl. No.: 48,683

[22] Filed: May 12, 1987

[51] Int. Cl.[4] ..... F16L 9/14

[52] U.S. Cl. ..... 428/358; 138/143; 138/145; 428/33; 428/35.9; 428/192

[58] Field of Search ..... 428/33, 36, 188, 192, 428/35.8, 35.9; 138/143, 145, 146; 427/287; 264/173, 209.3, 176.1 X, 177.1 X

[56] References Cited

U.S. PATENT DOCUMENTS

| | | | |
|---|---|---|---|
| 3,941,087 | 3/1976 | Yazaki | 118/306 |
| 4,514,243 | 4/1985 | Moore et al. | 264/173 |
| 4,606,953 | 8/1986 | Suzuki et al. | 138/143 |

*Primary Examiner*—Ellis P. Robinson
*Assistant Examiner*—James J. Seidleck
*Attorney, Agent, or Firm*—Vorys, Sater, Seymour & Pease

[57] ABSTRACT

A resin coated metal pipe has a plane surface portion formed with a coating resin as one body. By arranging many resin coated metal pipes in parallel such that the plane surface portions point upward, a lightweight structure, such as a bench, a flower stand, a draining board, and so forth can be assembled easily. Slippery or anti-slippery synthetic resin may be used as a part of or all the plane surface portion having a color different from the coating resin.

18 Claims, 8 Drawing Sheets

RESIN COATED METAL PIPE HAVING A PLANE SURFACE FOR A LIGHTWEIGHT STRUCTURE

BACKGROUND OF THE INVENTION

The present invention relates generally to a resin coated metal pipe for a lightweight structure which is manufactured by spreading adhesive on an outer surface of a thin metal pipe and coating synthetic resin on the adhesive so as to adhere the synthetic resin to the metal pipe and which is used as a raw material to construct a so called lightweight structure, such as a bench shown in FIG. 13, a flower stand shown in FIG. 3, a draining board shown in FIG. 9 or the like. More particularly, this invention relates to a resin coated metal pipe having a basically circular cross sectional shape and a plane surface for forming a flat surface for use in a lightweight structure.

A conventional resin coated metal pipe 1 for a lightweight structure, having a cross sectional shape as shown in FIG. 22, is manufactured by spreading adhesive 10 on an outer surface of a cold rolled steel pipe 2 having a circular shape and a thin thickness. In other words, the cross sectional shape of the conventional resin coated metal pipe 1 is circular. In the past, the resin coated metal pipe 1 was employed to construct a lightweight structure, such as a bench 4 shown in FIG. 23, a flower stand 5 shown in FIG. 24, a draining board 6 shown in FIG. 25 or the like.

As described hereinbefore by reference to FIG. 22, the cross sectional shape of the conventional resin coated metal pipe is purely circular. In the bench 4 of FIG. 23, since a seat portion A thereof consists of many resin coated metal pipes 1 provided in parallel, a surface of the seat portion is uneven. Since the aligned pipes do not create a flat surface, the seat surface corresponds to upper halves of the aligned pipes. Thus, a disadvantage of this bench 4 is that it is very uncomfortable to sit on. Even if the resin coated metal pipe 1 is used to form a floor for a cattle shed or a back support for a chair, the same disadvantage may exist.

In the flower stand 5 of FIG. 24, an additional board 7 is mounted on a table portion B, because a flowerpot would not rest stably if the flowerpot is directly put on the table portion B formed by the resin coated metal pipes 1. This requires more labor and is expensive because of the additional board 7.

In the draining board 6 of FIG. 25, the resin coated metal pipes 1 are used as crosspieces and a board 8 is positioned thereon to form a floor surface because of the above described disadvantage. It is difficult to tightly adhere the board 8 to the resin coated metal pipes 1 without limiting the usage thereof. Therefore, the board 8 is normally fixed with nails or screws 9 as illustrated in FIG. 26. Thus, the draining board 6, assembled as described above requires much trouble and labor; is expensive to manufacture; and the finished product is not much to look at. In addition, strength and security of the screw fixed portion may be poor, and the life thereof may not be long because it is bitten with water. The water may percolate through the screw fixed portion to the inside of the resin coated metal pipe 1, thereby expanding the bitten area and decreasing the life of the draining board.

SUMMARY OF THE INVENTION

A resin coated metal pipe having a plane surface for a lightweight structure according to the present invention can overcome the aforementioned disadvantages of the prior art. A present invention is the resin coated metal pipe used for a lightweight structure and manufactured by adhesively coating synthetic resin on the outer surface of a thin metal pipe. This metal pipe is characterized in that a plane surface portion thereof having a desired width is formed with coating resin as one body in the direction of a tangent line of the outer surface of the resin coated metal pipe.

Turndown edges are provided at the side ends of the plane surface portions in parallel with a pipe axis line. Projections and grooves may be provided on the outer side surfaces of the turndown edges such that the adjacent turndown edges may be coupled tightly with each other. A part of or all the plane surface portions may be made of a material different from the coating resin. For example, the material may be a soft synthetic resin, an anti-slippery synthetic resin, or a different color synthetic resin. Moreover, the plane surface portion may be formed by planing off the edges of the coating resin.

To form a seat portion of a bench, a table portion of a flower stand or a floor surface of a draining board, the plane surface portions of the resin coated metal pipes are turned upwardly. The planar surfaces may be apparent without an additional process. These planar surfaces will not be substantially rough and therefore may act as the seat portion which is comfortable to sit on, the table portion on which a flowerpot stands stably, or the good floor surface on which a person walks easily. Finally, they are much more attractive, as well.

Since the planar surface is directly formed by the resin coated metal pipe, the lightweight structure having the planar surface, such as the bench, flower stand, draining board, etc., is assembled only by the resin coated metal pipes. Therefore, it is not necessary to prepare and mount an additional board, so that it is simple to assemble. There is no problem with strength, security or corrosion as is caused by the prior art's board fixed portion.

By forming the plane surface portions with either synthetic resin of a soft material or an anti-slippery material, the bench may be comfortable to sit on or the draining board may be flat and coarse to prevent dangerous slip. When forming a part of or all the plane surface portion with a synthetic resin having a desired color, the finished lightweight structure may be more colorful and present an even finer spectacle.

It is therefore an object of the present invention to provide an improved resin coated metal pipe having a plane surface portion of synthetic resin which can be directly used in conjunction with other resin coated metal pipes to create a planar surface of a lightweight structure.

It is another object of the present invention to provide an improved resin coated metal pipe which is useful to assemble a lightweight structure, such as a bench, a flower stand, a draining board or the like.

Other objects and advantages of the present invention will become apparent upon a reading of the following description taken in conjunction with the accompanying drawings.

DETAILED DESCRIPTION OF THE INVENTION

First Embodiment

Figure 1:
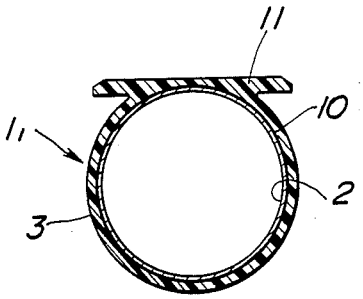
FIG. 1 is a cross sectional view of a first embodiment of a resin coated metal pipe according to the present invention.
Figure 2:
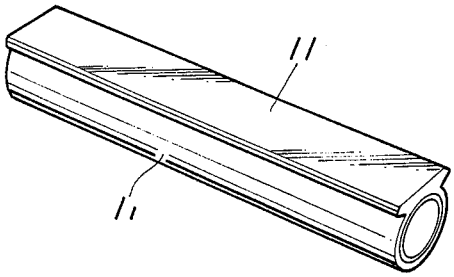
FIG. 2 is a perspective view of the first embodiment of the present invention shown in FIG. 1.

Referring to FIGS. 1 and 2, there is shown a resin coated metal pipe 1(1) which is manufactured by applying adhesive 10 to an outside surface of a cold rolled steel circular pipe 2 having about an 0.8 mm thickness uniformly coating it with synthetic resin 3, such as AAS, about 1 mm thick, and thereby adhering the synthetic resin 3 to the steel pipe 2. A plane surface portion 11 is formed with the coating resin 3 as one body by making a part of the coating resin 3 thicker, and is substantially parallel with a tangent of the resin coated metal pipe 1(1). The coating resin 3 and the plane surface portion 11 are formed using an extrusion method. An outside diameter of the pipe 1(1) is normally about 28 through 32 mm, and a width of the plane surface portion 11 is substantially equal to the outside diameter of the pipe.

Figure 3:
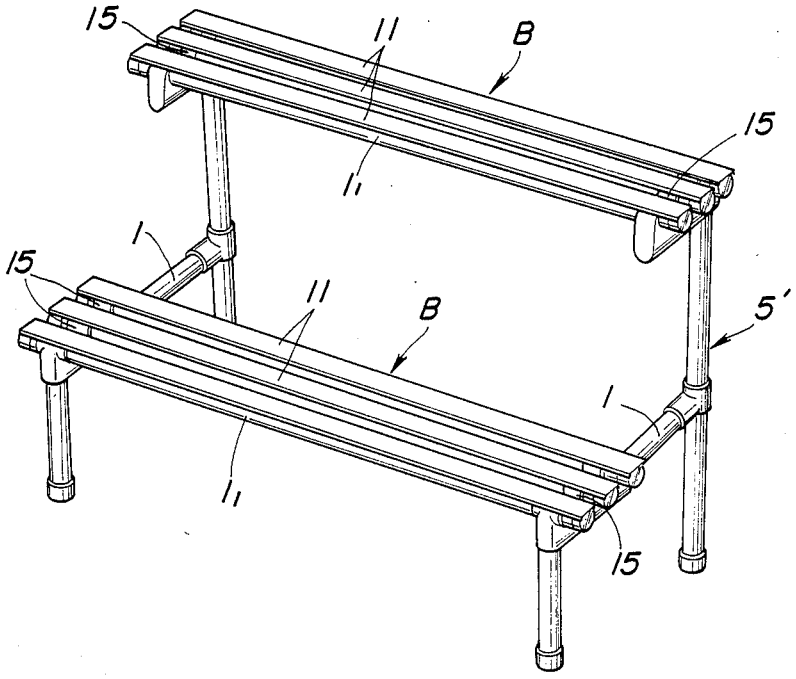
FIG. 3 is a perspective view of a flower stand as an application of the first embodiment of the present invention.

FIG. 3 illustrates a flower stand 5' wherein a table portion B is formed by mounting the resin coated metal pipes 1(1) so that the plane surface portions 11 point upward. The resin coated metal pipes 1(1) are coupled with frames 1 of the stand via cross joints 15 (refer to cross joints 16 in Second Embodiment In FIG. 4, a plane board portion 12 is formed with the coating resin 3 as one body at an outer surface of a resin coated metal pipe 1(2) substantially in parallel with the tangent thereof. The width of the plane board 12 is about 100 through 150 mm, the thickness thereof is about 2 through 3 mm, and the cross sectional shape thereof is a trapezoid having both end portions slightly bent inward symmetrically. FIG. 5 shows a modification of the embodiment of FIG. 4, wherein projections 26 are provided at the center portion and both the bent side portions of the plane board 12 make these portions thicker. As a result, prior imbalance of resin contractibility and design value of the resin coated metal pipe are improved.

Figure 4:
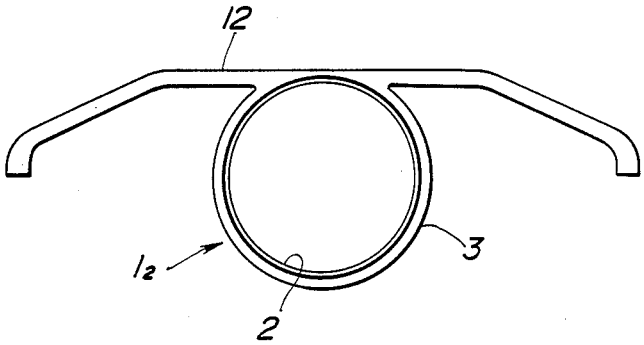
FIG. 4 is a front view of a second embodiment according to the present invention.
Figure 5:
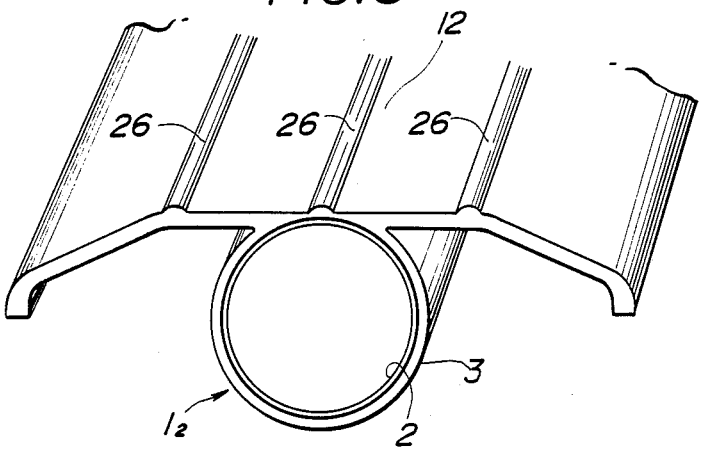
FIG. 5 is a perspective view of a modification of the second embodiment of the present invention shown in FIG. 4.
Figure 6A:
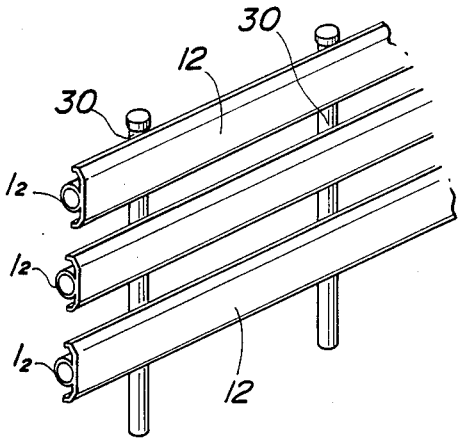
FIGS. 6A and 6B are respectively perspective and side views of a guardrail as an application of the resin coated metal pipe shown in FIG. 5.
Figure 6B:
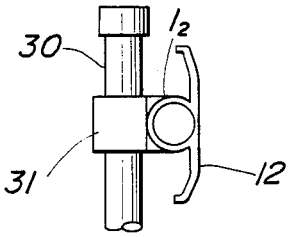

FIG. 6 shows a guardrail assembled by using the resin coated metal pipe of FIG. 4. The resin coated metal pipes 1(2) are arranged in the substantially horizontal direction and are fixed to props 30 for the cylindrical pipes.

Third Embodiment

Figure 7:
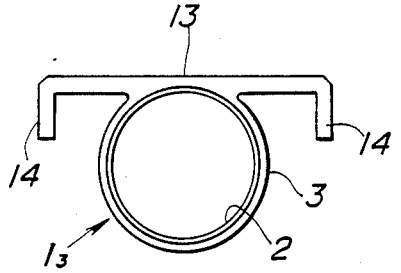
FIG. 7 is a front view of a third embodiment according to the present invention.
Figure 8:
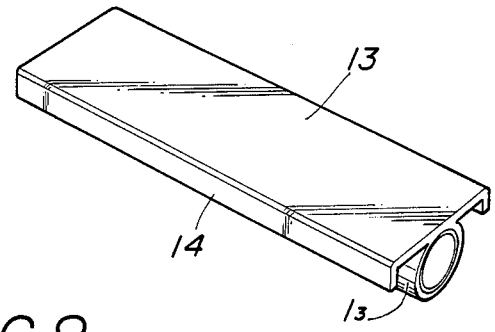
FIG. 8 is a perspective view of the third embodiment of the present invention shown in FIG. 7.

In FIGS. 7 and 8, a plane surface portion 13 having about 50 through 100 mm width is formed as a single body at an outer surface of a resin coated metal pipe 1(3) along the tangent thereof. Turndown edges 14 are provided at both the side ends of the plane surface portion 13 by bending them at about a right angle toward the pipe.

Figure 9:
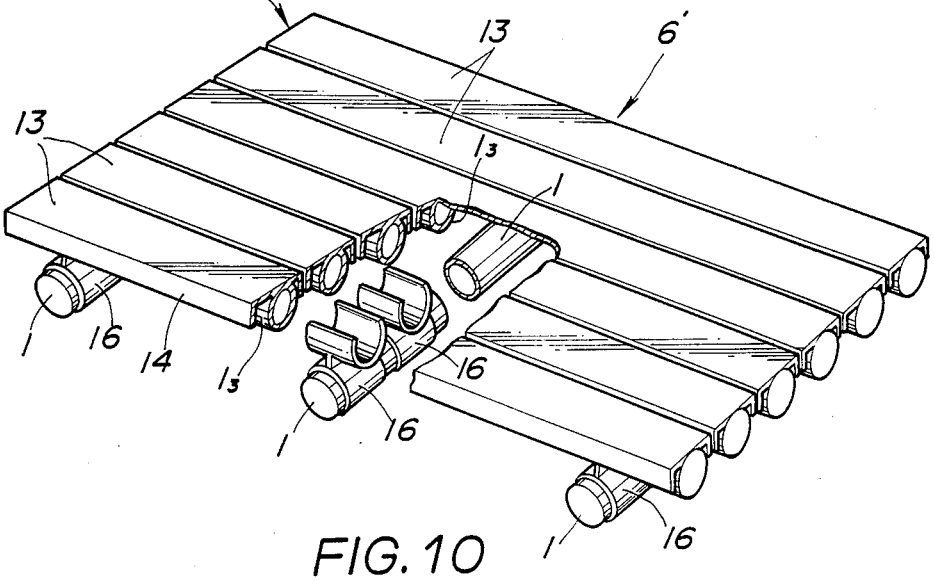
FIG. 9 is a perspective view of a draining board as an application of the third embodiment of the present invention.

FIG. 9 shows a draining board 6' using the resin coated metal pipe 1(3), wherein the plane surface portions 13 of the pipes 1(3) point upward and these pipes are coupled with crosspieces 1 via cross joints 16. The plane surface portions 13 are arranged in parallel such that the adjacent turndown edges 14 face each other and there are predetermined spaces therebetween. As a result, a flat floor surface C may be obtained.

Fourth Embodiment

Figure 10:
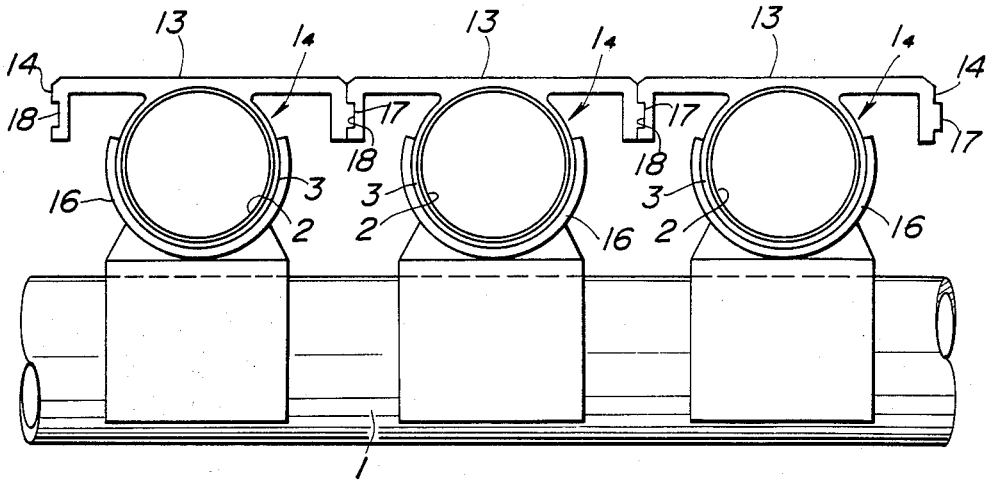
FIG. 10 is a cross sectional view of a structure using a fourth embodiment according to the present invention.

FIG. 10 shows a draining board 6' as shown in FIG. 9 or a veranda using resin coated metal pipes 1(4) which include projections 17 and grooves 18 provided along the pipe axis at the outer surfaces of the turndown edges 14 in the third embodiment. The projection and the groove of the adjacent turndown edges are coupled tightly to each other (because of the same shape and size of the projection and the groove). As a result of the tight coupling of the projections 17 and the grooves 18, the plane surface portions 13 reinforce each other. Thus, the floor C may not bend and thereby resolves any bending problem.

Fifth Embodiment

Figure 11:
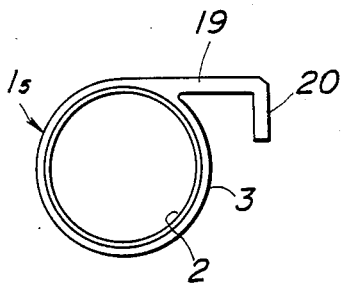
FIG. 11 is a front view of a fifth embodiment according to the present invention.
Figure 12:
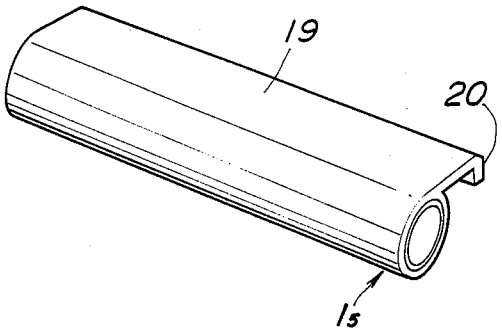
FIG. 12 is a perspective view of the fifth embodiment of the present invention shown in FIG. 11.

FIGS. 11 and 12 illustrate a resin coated metal pipe 1(5) having a single wing type plane surface portion 19 in the tangent direction of the outer surface of the pipe and having a turndown edge 20 in parallel with the pipe axis.

Figure 13:
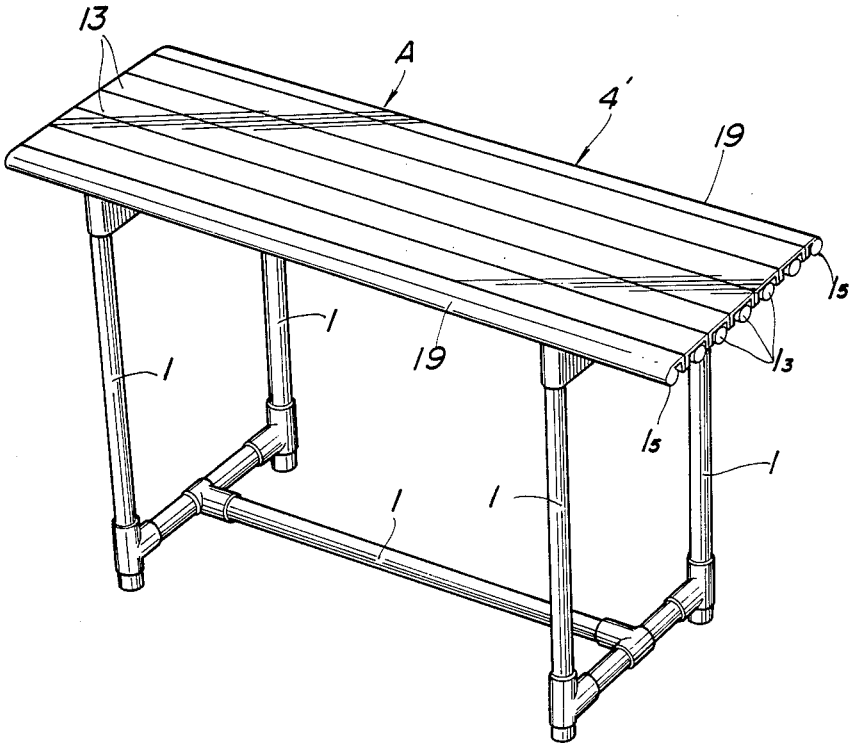
FIG. 13 is a perspective view of a bench as an application of the fifth embodiment of the present invention.

FIG. 13 illustrates a bench 4' having a seat portion A formed by the resin coated metal pipes 1(5) of this embodiment and the pipes 1(3) of the third embodiment (FIG. 7). The greater part of the seat portion A is assembled by arranging a plurality of the pipes 1(3) of the third embodiment in parallel with the upward plane surface portions 13 and by arranging the pipes of this embodiment with the inward plane surface portions 19 at both the longitudinal sides edges of the seat portion A. Thus, both longitudinal side edges of the seat portion A are roundish because of the outer surface of the pipe 1(5), and therefore are comfortable to sit on. Because the heaviest load is received at both sides, the plane surface portions are protected from breaking when a person sits on the bench.

The pipe 1(5) of this embodiment can not only be used for the bench 4' of FIG. 13 but also for both longitudinal side edges of the draining board 6' shown in FIG. 9.

Sixth Embodiment

Figure 14:
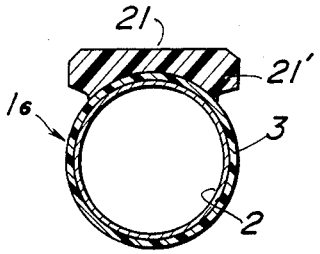
FIG. 14 is a cross sectional view of a sixth embodiment of the resin coated metal pipe according to the present invention.
Figure 15:
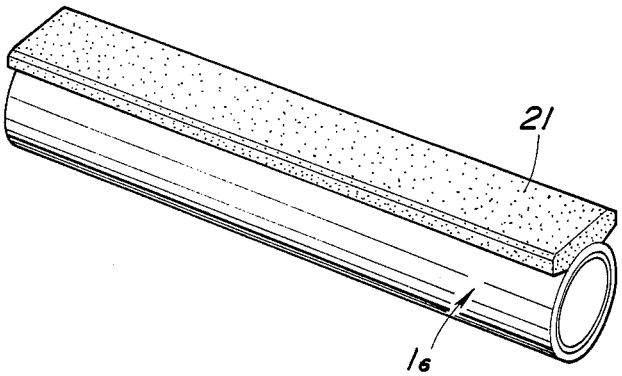
FIG. 15 is a perspective view of the sixth embodiment of the present invention shown in FIG. 14.

FIGS. 14 and 15 show a resin coated metal pipe 1(6) which is similar to the pipe 1(1) of FIG. 1 in external shape. However, all of a plane surface portion 21 is made of material 21' having a good slippery characteristic (low friction coefficient) and being different from the coating resin 3. The material 21' is, for example, a composite resin obtained by mixing fluoroplastics with polypropylene, high density polyethylene, nylon, polyacetals, polyethylene terephthalate (PET), polyethylene terephthalate (PBT) or the like. Of course, it is important to select resin materials of the coating resin 3 and the plane surface portion 21 such that they join together easily. Both of them are formed simultaneously as one body by the extrusion method.

Figure 16:
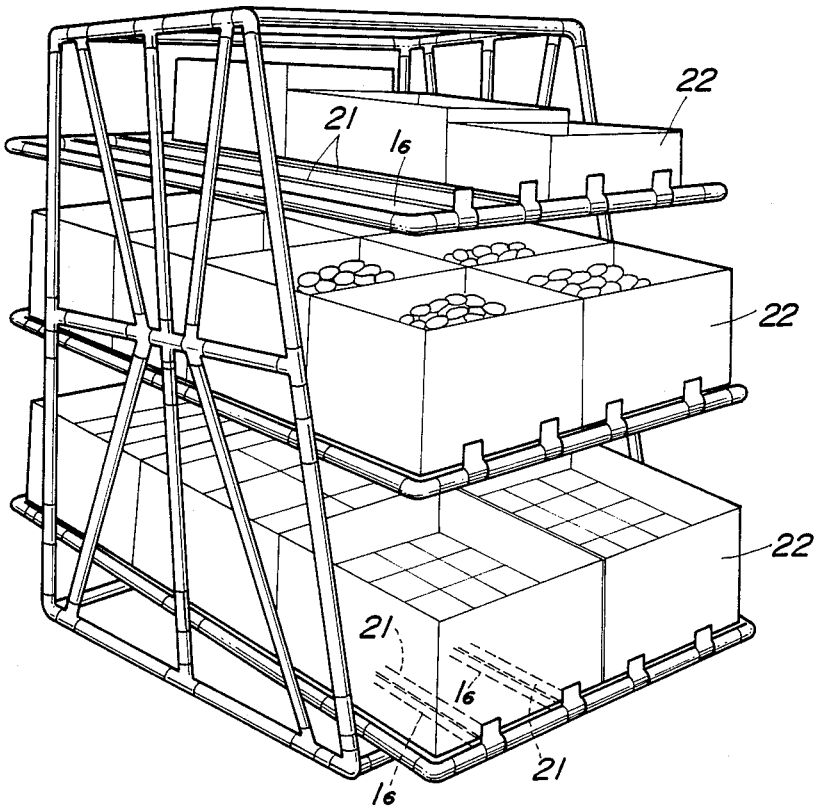
FIG. 16 is a perspective view of a flow rack as an application of the sixth embodiment of the present invention.

FIG. 16 shows a flow rack wherein the pipes 1(6) of this embodiment are used as sliding rails and guide rails of a sliding table. The plane surface portion 21 is used to receive or support an object 22.

Seventh Embodiment

Figure 17:
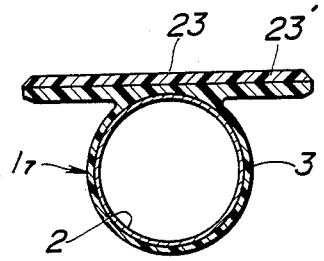
FIG. 17 is a cross sectional view of a seventh embodiment of the resin coated metal pipe according to the present invention.
Figure 18:
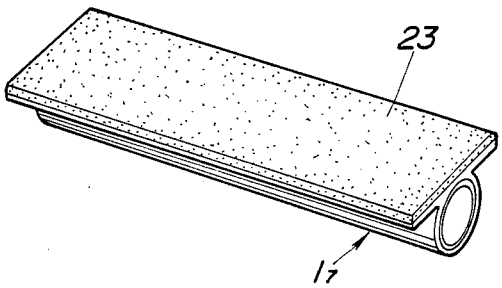
FIG. 18 is a perspective view of the seventh embodiment of the present invention shown in FIG. 17.

FIGS. 17 and 18 illustrate a resin coated metal pipe 1(7) which is similar to the pipe 1(2) of FIG. 4 in external shape. However, an upper half of a plane surface portion 23 is made of material different from the coating resin 3, which may be, for example, many kinds of resin foam member or elastic and anti-slippery resin, such as polyurethane rubber, ethylene propylene rubber or, ethylene vinyl acetate copolymer (EVA).

If the pipe 1(7) of this embodiment is used to form the floor of the draining board (or a slippery surface when wet), it maintains the safety because of the anti-slippery characteristic. If it is used for the flower stand, it prevents the flowerpot from slipping and dropping therefrom. When the upper half portion 23' is made of good cushion (soft) material, it is proper for the seat portion of the bench or a back portion of a chair and is comfortable to sit on or lean on.

Eighth Embodiment

Figure 19:
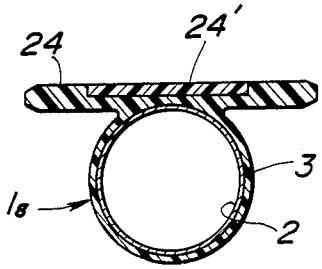
FIG. 19 is a cross sectional view of an eighth embodiment of the resin coated metal pipe according to the present invention.
Figure 20:
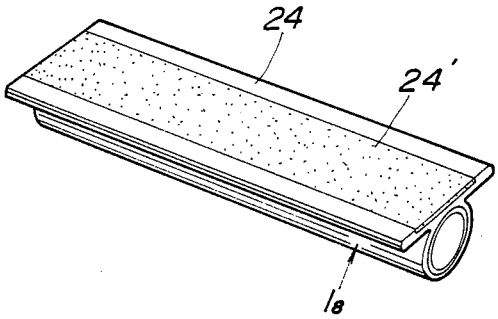
FIG. 20 is a perspective view of the eighth embodiment of the present invention shown in FIG. 19.

FIGS. 19 and 20 show a resin coated metal pipe 1(8) which is similar to the pipe 1(2) of FIG. 4 in external shape; however, a center part 24 of a plane surface portion 24 is made of synthetic resin having a different color for the coating resin 3. The width of the center part is half width of the plane surface portion 24. By using the pipes 1(8) to assemble the draining board 6', the flower stand 5' or the bench 4', the colorful or two tone finished product can be designed. As a result, the product value may increase.

Figure 21:
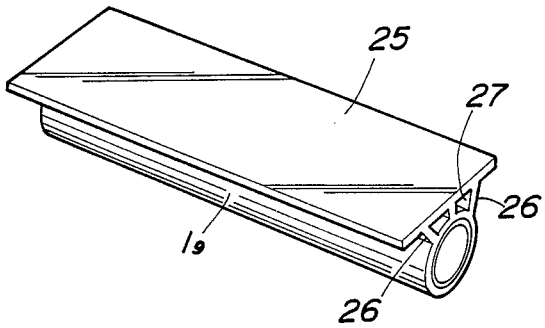
FIG. 21 is a perspective view of a ninth embodiment according to the present invention.
Figure 22:
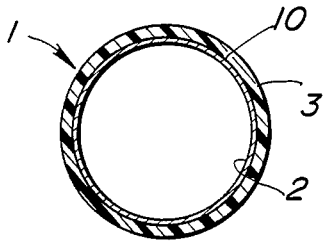
FIG.22 (PRIOR ART)
FIG. 22 is a cross sectional view of a conventional resin coated metal pipe.
Figure 23:
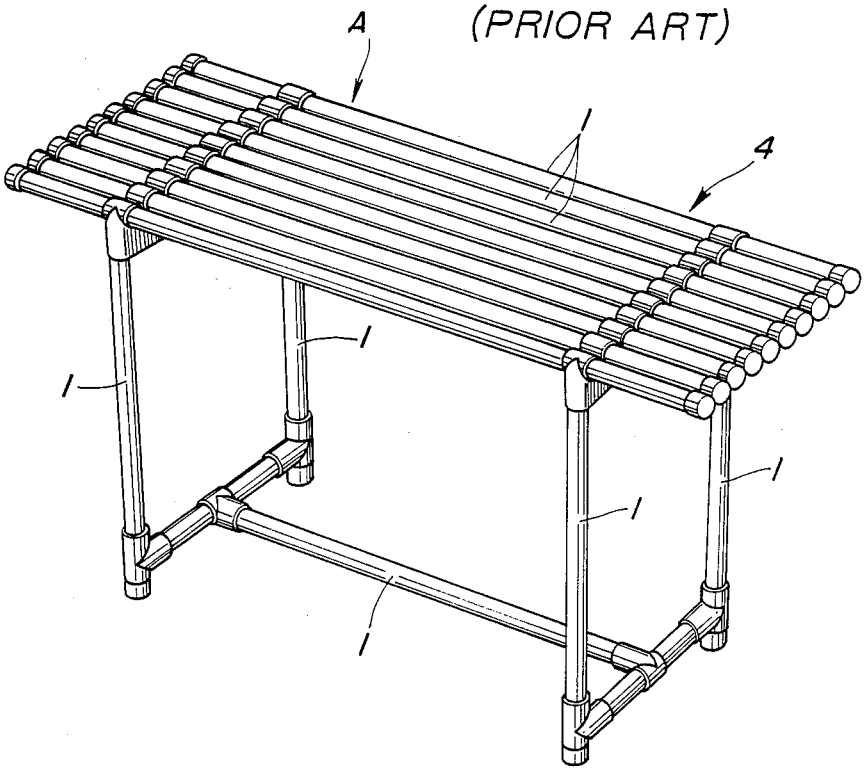
FIG.23 (PRIOR ART)
FIGS. 23 through 25 are respectively perspective views of a bench, a flower stand and a draining board as applications of the prior art shown in FIG. 22.
Figure 24:
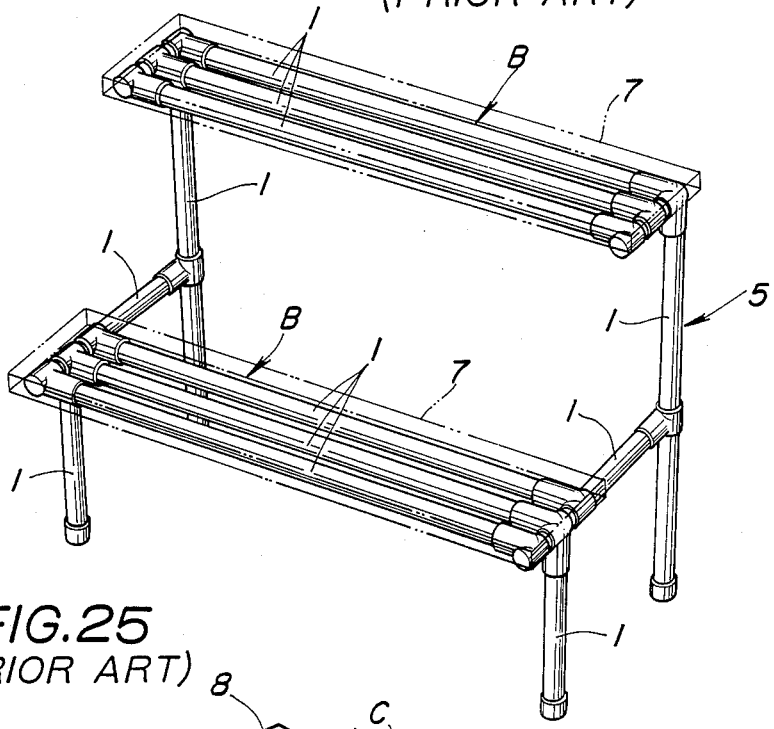
FIG.24 (PRIOR ART)
Figure 25:
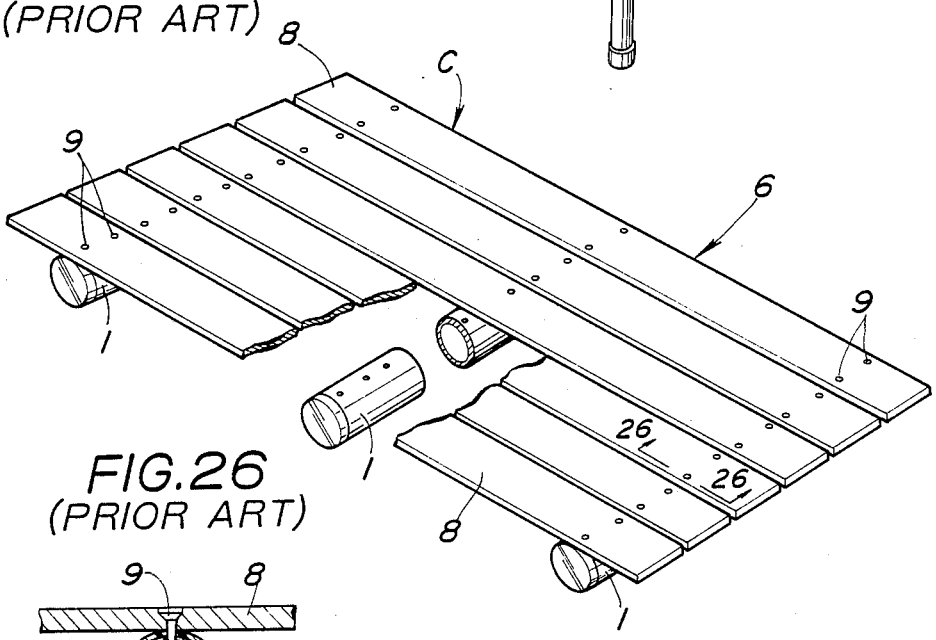
FIG.25 (PRIOR ART)
Figure 26:
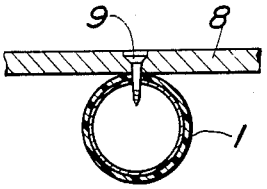
FIG.26 (PRIOR ART)
FIG. 26 is a cross sectional view along lines 27—27 of FIG. 25.

Ninth Embodiment:

In the resin coated metal pipes 1(1) through 1(8) shown in FIGS. 1 through 20, the plane surface portions are directly attached to the outer surfaces of the pipes in the tangent direction thereof. However, in a resin coated metal pipe 1(9) of FIG. 21, a plane surface portion 25 is spaced from the outer surface of the pipe by a predetermined distance via ribs 26 and cavities 27. This embodiment can be applied to many applications similar to the above discussed embodiments, but this embodiment can easily be adapted to conventional joints or caps by cutting the plane surface portion 25 and the ribs 26.

As understood from the foregoing description, according to the resin coated metal pipes having the plane surfaces 1(1) through 1(9) for the lightweight structures of the present invention, the plane surface portions 11 through 25 are useful to make the surface of the product flat (such as the seat portion A of the bench 4', the table portion B of the flower stand 5' on which the flowerpot is put, the floor C of the draining board or the like). Thus, they can satisfy the essential conditions requested of the products, e.g., comfortable to sit on, stable to stand a flowerpot, easy to use, or good to feel. Moreover, the product may be improved in quality, efficiency, value, and so forth. Since no additional board is necessary to satisfy the plane surface condition, the present invention is simple to manufacture and is inexpensive to construct. The present invention presents a fine spectacle. In addition, the present invention can resolve the disadvantages of the case that the additional board is fixed, e.g., decreasing strength and security of the screw portion, decreasing the life because of corrosion, expanding a corrosion area when water percolates through the screw portion.

It is obvious to those having ordinary skill in the art that many changes may be made in the above described details of the preferred embodiments of the present invention without departing from the spirit and scope of the present invention. Therefore, the scope of the present invention should be determined only by the following claims, and the examples are illustrative not limiting.

We claim:

1. In a resin coated metal pipe for a lightweight structure including a synthetic resin coated and adhered on an outer surface of a thin metal pipe to form a resin coated pipe, said resin coated metal pipe having a plane surface for said lightweight structure characterized in that a plane surface portion having a predetermined width can be formed with said resin as one body in the tangent direction of the outer surface of said resin coated metal pipe, wherein a turndown edge is provided at a side end of said plane surface portion in parallel with a pipe axis.

2. A resin coated metal pipe having a plane surface for a lightweight structure according to claim 1, wherein a projection or a groove is provided at an outer surface of said turndown edge in parallel with said pipe axis such that said turndown edge can be tightly coupled with an adjacent turndown edge.

3. A resin coated metal pipe having a plane surface for a lightweight structure according to claim 1, wherein at least a part of said plane surface portion is made of synthetic resin having a color different from said resin for coating.

4. A resin coated metal pipe for a lightweight structure including a first synthetic resin coated and adhered on an outer surface of a thin metal pipe to form a resin coated metal pipe;

said resin coated metal pipe having a plane surface for said lightweight structure characterized in that a plane surface portion having a predetermined width is formed with a second resin in the tangent direction of said resin coated metal pipe;

wherein at least a part of said plane surface portion is made of synthetic resin different from said first resin coating said pipe;

wherein a turndown edge is provided at a side end of said plane surface portion in parallel with a pipe axis.

5. A resin coated metal pipe having a plane surface for a lightweight structure according to claim 4, wherein at least a part of said plane surface portion is made of synthetic resin having a color different from said resin coating said pipe.

6. A resin coated metal pipe having a plane surface for a lightweight structure according to claim 4, wherein a projection or a groove is provided at an outer surface of said turndown edge in parallel with said pipe axis such that said turndown edge can be tightly coupled with an adjacent turndown edge.

7. An article of manufacture comprising:

a plurality of resin coated pipes having a pipe coated with a synthetic resin secured to said pipe and forming a plane surface portion substantially parallel with a longitudinal axis of said pipe; and means for securing said plurality of resin-coated pipes in a spaced array with said plane surface portions forming a planar surface, to form said article of manufacture;

wherein said resin is a synthetic resin substantially entirely coating an outer surface of said pipe, said plane surface portion being integral with said resin coating on said pipe;

wherein said pipe further includes at least one turned down edge at a side end of said plane surface and extending in parallel with said longitudinal pipe axis.

8. The article as set forth in claim 7 wherein said turned down edge defines means at an outer surface of said turned down edge for coupling with an adjacent edge of an adjacent pipe member in said article of manufacture.

9. The article as set forth in claim 8 wherein said coupling means is a groove extending in parallel with said longitudinal axis.

10. The article as set forth in claim 7 wherein said turned down edge is provided at each side end of said plane surface.

11. The article as set forth in claim 7 wherein said coupling means includes a projection on said edge for coupling with a groove on an adjacent edge.

12. The article as set forth in claim 10 wherein a projection is provided at one side end of said planar portion and a groove is provided at said opposite side edge, said groove and said projection mating when a pair of said pipes are placed side-by-side.

13. The article as set forth in claim 7 wherein said plane surface portion is a single wing type plane surface portion in a direction tangent to an outer surface of said pipe and defining a turned down edge in parallel with the longitudinal axis of said pipe.

14. The article as set forth in claim 7 wherein a first resin coating said pipe is different from a second resin forming said plane surface portion.

15. The article as set forth in claim 14 wherein said second resin is a composite resin obtained by mixing fluoroplastics with polypropylene terephthalate (PET), polybutylene terephthalate (PBT) or the like.

16. The article as set forth in claim 7 wherein said plane surface portion is spaced from an outer surface of said pipe at a predetermined distance by ribs.

17. In a resin coated metal pipe for a lightweight structure including a first synthetic resin coated and adhered on an outer surface of a thin metal pipe to form a resin coated metal pipe;

said resin coated metal pipe having a plane surface for said lightweight structure characterized in that a plane surface portion having a predetermined width is formed with a second resin in the tangent direction of said resin coated metal pipe; wherein at least a part of said plane surface portion is made of synthetic resin different from said first resin coating said pipe.

18. An article of manufacture comprising:

a plurality of resin coated pipes having a pipe coated with a synthetic resin secured to said pipe and forming a plane surface portion substantially parallel with a longitudinal axis of said pipe; and means for securing said plurality of resin-coated pipes in a spaced array with said plane surface portions forming a planar surface, to form said article of manufacture.

* * * * *